United States Patent [19]

Deutsch

[11] 4,353,279

[45] Oct. 12, 1982

[54] APPARATUS FOR PRODUCING ENSEMBLE TONE IN AN ELECTRIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 230,242

[22] Filed: Feb. 2, 1981

[51] Int. Cl.³ ..... G10H 1/02; G10H 7/00

[52] U.S. Cl. ..... 84/1.24; 84/DIG. 4

[58] Field of Search ..... 84/1.22, 1.23, 1.24, 84/DIG. 4

[56] References Cited

U.S. PATENT DOCUMENTS

| | | | |
|---|---|---|---|
| 3,809,792 | 5/1974 | Deutsch | 84/1.24 |
| 3,884,108 | 5/1975 | Deutsch | 84/1.24 |
| 3,978,755 | 9/1976 | Woron | 84/1.24 |
| 3,994,195 | 11/1976 | Chibana et al. | 84/1.24 |
| 4,112,803 | 9/1978 | Deutsch | 84/1.24 |
| 4,205,579 | 6/1980 | Kakehashi | 84/1.24 |
| 4,257,303 | 3/1981 | Nagai et al. | 84/1.22 |
| 4,259,888 | 4/1981 | Gross | 84/1.22 |
| 4,273,019 | 6/1981 | Goto | 84/1.24 |
| 4,294,155 | 10/1981 | Turner | 84/1.24 X |

*Primary Examiner*—Stanley J. Witkowski

*Attorney, Agent, or Firm*—Ralph Deutsch

[57] ABSTRACT

An ensemble effect is produced in a digital tone generator by providing a master data set of words having values corresponding to the relative amplitudes of equally spaced points along one cycle of a waveform of a musical tone in which the fundamental frequency is deleted. These values are read sequentially and repetitively from a memory to produce a first analog tone. A second analog tone is produced by multiplying a data set corresponding to the fundamental frequency by a low frequency sinusoid. The first and second analog tones are summed to yield a musical tone having an ensemble effect.

13 Claims, 3 Drawing Figures

APPARATUS FOR PRODUCING ENSEMBLE TONE IN AN ELECTRIC MUSICAL INSTRUMENT

BACKGROUND OF THE INVENTION

1. Field of the Invention

This invention relates to electronic musical tone synthesizers and in particular is concerned with a digital tone generator producing an ensemble effect.

2. Description of the Prior Art

It is widely recognized that the tonal performance of an electronic musical instrument is enhanced by producing tones having an ensemble effect. The usual method of producing an ensemble effect is to generate two, or more, tones, whose fundamental frequencies differ by some small frequency difference. The motivation is to imitate the ensemble tone produced by a chorus of musical instruments which are not precisely in tune. It is this type of "out-of-tune" ensemble that produces the warm tone produced by a section of violins even when they are played in unison.

Various arrangements have been employed to electronically generate two simultaneous tones which are slightly detuned. The straightforward arrangement is to simply duplicate each tone generator and to use detuned clocks for each tone generator. Unfortunately the straightforward arrangement is usually an expensive solution because of the cost associated with duplicating the entire tone generation system. There is also the problem of using two clocks which must be only slightly out-of-tune and cannot be allowed to drift independently in frequency with changes in their ambient conditions.

Several arrangements have been developed for obtaining the two out-of-tune tone generators required for an ensemble effect by using only a single clock for both tone generators. Representative prior art is described in the following patents.

In U.S. Pat. No. 3,809,792, entitled "Production Of Celeste In A Computor Organ," apparatus is described for producing a celeste effect in a tone generator wherein the amplitudes of successive sample points of a musical waveshape are computed in real time. The amplitude of each sample point is obtained by summing two sets of Fourier components. One set is associated with the true pitch of the selected note and the second set is generated at a slightly higher pitch. The net result is a celeste-like effect, or an ensemble effect.

In U.S. Pat. No. 4,112,803 entitled "Ensemble And Anharmonic Generation In A Polyphonic Tone Synthesizer" a method is described for producing two out-of-tune musical tones. The first tone is produced in the manner described in U.S. Pat. No. 4,085,644 entitled "Polyphonic Tone Synthesizer." The second tone is produced by using the same waveshape data as that computed for the first tone and repetitively reading out the data from a memory while slowly advancing the starting memory address. This action is equivalent to producing a linear phase shift which produces a tone at an increased frequency with respect to the note clock used to address the waveshape data from the memories. The net result is the production of two out-of-tune musical tones by using only a single note clock and a low frequency timing source.

In U.S. Pat. No. 4,205,580 entitled "Ensemble Effect In An Electronic Musical Instrument" a method is described for producing an ensemble effect in a tone generator of the type described in the above referenced U.S. Pat. No. 4,085,644. The waveshape data stored in the master data set are converted to analog signals by means of two digital-to-analog converters. The ensemble effect is produced by transferring data to the second converter at the same rate that data is transferred to the first converter but by having either one data point deleted or repeated in the second data set. Because the second data set has one less, or one extra, data point, the resulting musical tones from the two digital-to-analog converters change phase linearly with respect to each other with each successive cycle of the waveshape and thereby produces the desired detuning for an ensemble effect.

SUMMARY OF THE INVENTION

The present invention is directed to apparatus for producing an ensemble effect in a musical tone generator in which the tonal effect of multiple tones is created by a single tone generator which uses two master data sets comprised of selected waveshape sample data points.

In a Polyphonic Tone Synthesizer of the type described in U.S. Pat. No. 4,085,644, a computation cycle and a data transfer cycle are repetitively and independently implemented to provide data which are converted to musical waveshapes. During the computation cycle a first and a second master data set are created by implementing a discrete Fourier algorithm using stored sets of harmonic coefficients which characterize preselected musical tones. The computations are carried out at a fast rate which may be nonsynchronous with any musical frequency. Preferably the harmonic coefficients and the orthogonal functions required by the Fourier algorithm are stored in digital form and the computations are carried out digitally. At the end of a computational cycle the master data sets are stored in separate registers.

Following a computation cycle, a transfer cycle is initiated during which the master data sets are transferred to preselected members of a multiplicity of tone generators. The output tone generation continues uninterrupted during the computation and transfer cycles.

A note clock, operating at a frequency corresponding to an actuated keyboard switch, is used to address out values of the first master data set stored in a tone generator into a digital-to-analog converter to produce a first output analog waveform. The same note clock is used to address out values of the second master data set which are stored in a corresponding tone generator. The note clock is divided in frequency by a factor of 512 and the divided clock rate is used to address successive trigonometric values stored in a sinusoid table. The addressed out values of the second master set are multiplied by the trigonometric values read out of the sinusoid table. The product data values are converted to an analog signal which is summed with the first output analog waveform to produce the ensemble effect.

BRIEF DESCRIPTION OF THE DRAWINGS

For a better understanding of the invention reference should be made to the accompanying drawings.

DETAILED DESCRIPTION OF THE INVENTION

Figure 1:
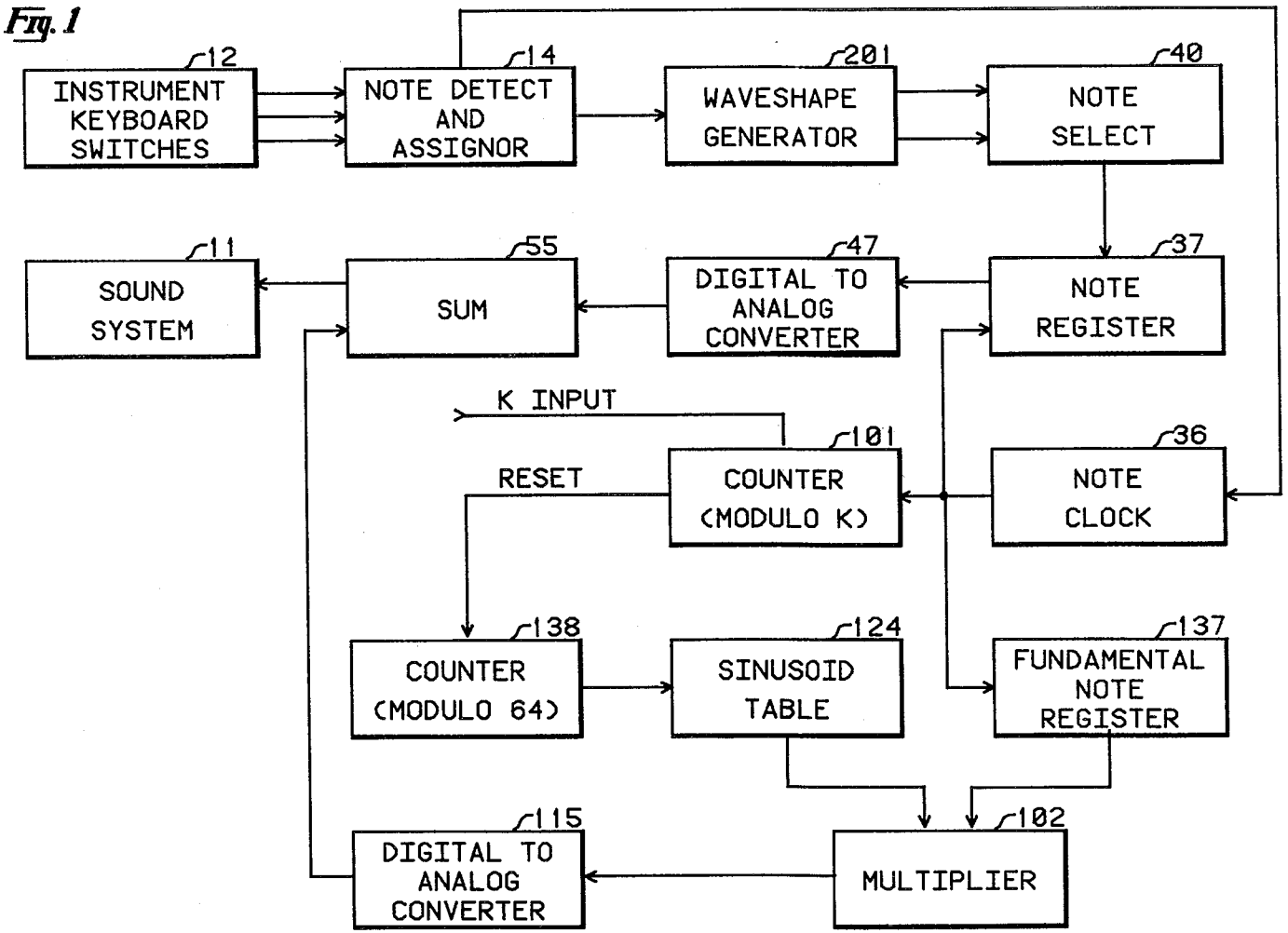
FIG. 1 is a block diagram of the ensemble tone generating system.

The present invention is directed to an improvement in a musical tone generation system of a type that repetitively reads successive waveshape sample points from a memory at a rate corresponding to an actuated switch on an array of keyboard switches. The sample points accessed from the memory are converted to analog musical signals by means of a digital-to-analog converter. A tone generation system of this type is described in detail in U.S. Pat. No. 4,085,644 entitled "Polyphonic Tone Synthesizer" and which is hereby incorporated by reference. In the following description all elements of the system which are described in the referenced patent are identified by two digit numbers which correspond to the same numbered elements used in the patent. All system element blocks which are identified by three digit numbers correspond to elements added to the Polyphonic Tone Synthesizer to implement the improvements of the present invention to produce an ensemble tone effect.

The ensemble tone effect generation system is motivated by the well-known trigonometric identity for the sum of two sinusoid functions:

$$\sin 2\pi f_1 t + \sin 2\pi f_2 t = 2 \sin [2\pi(f_1+f_2)t/2] \cos [2\pi(f_1-f_2)t/2]. \quad \text{Eq. 1}$$

Let $$f_2 = f_1 - g \quad \text{Eq. 2}$$

where g is a small frequency increment. Substitute Eq. 2 in Eq. 1 to obtain $$\sin 2\pi f_1 t + \sin 2\pi(f_1+g)t = 2 \sin[2\pi(f_1+g/2)t]\cos 2\pi g t/2 = 2 \sin 2\pi f_1 t \cos 2\pi g t/2. \quad \text{Eq. 3}$$

The last form of Eq. 3 is an approximation in which the frequency $f_1+g/2$ is replaced by $f_1$. Eq. 3 indicates that the sum of two sinusoid functions of slightly different frequencies can be generated by multiplying, or modulating, a sine function by the cosine function having one-half of the frequency difference as its argument.

Frequency comparisons of two musical frequencies are expressed in cents C according to the relation $$C = K \log f_1/f_2 \quad \text{Eq. 4}$$

where the constant K is defined as $$K = 1200/\log 2. \quad \text{Eq. 5}$$

From Eq. 4, the frequency $f_1$ can be expressed as $$f_1 = f_2 \exp (C/K). \quad \text{Eq. 6}$$

Substitute Eq. 6 in Eq. 2 to find the expression $$g = f_1(A-1)/A \quad \text{Eq. 7}$$

where the constant A is defined as $$A = \exp (C/K). \quad \text{Eq. 8}$$

The modulation frequency g/2 for any specified detuning expressed in cents between two frequencies can be calculated from Eq. 7. Typical values are shown in Table 1.

TABLE 1

| Cents | Fraction (A-1)/2A | Binary Fraction |
|---|---|---|
| 1 | 0.00029 | 0.000 000 000 001 |
| 2 | 0.00058 | 0.000 000 000 010 |
| 3 | 0.00087 | 0.000 000 000 100 |
| 4 | 0.00115 | 0.000 000 000 101 |
| 5 | 0.00144 | 0.000 000 000 110 |
| 6 | 0.00173 | 0.000 000 000 111 |
| 7 | 0.00202 | 0.000 000 001 000 |
| 8 | 0.00231 | 0.000 000 001 001 |
| 9 | 0.00259 | 0.000 000 001 011 |
| 10 | 0.00288 | 0.000 000 001 100 |
| 11 | 0.00317 | 0.000 000 001 101 |
| 12 | 0.00345 | 0.000 000 001 110 |
| 13 | 0.00374 | 0.000 000 001 111 |
| 14 | 0.00403 | 0.000 000 010 001 |
| 15 | 0.00431 | 0.000 000 010 010 |

It is noted from the entries of Table 1 that a detuning frequency difference of 7 cents corresponds to the binary number 0.000 000 001 000. 7 cents is an advantageous choice for an ensemble detuning and the corresponding binary number fraction of $2^{-9}=1/512$ is easily implemented as a left binary shift of 9 bit positions.

In FIG. 1, the collection of keyswitches for the electronic musical instrument is shown generally by the system block labeled instrument keyboard switches 12. Whenever a keyswitch is actuated or released on a keyboard, note detect and assignor 14 detects such keyboard switch state changes and stores, for each actuated switch, information corresponding to the note within an octave, the octave number for the keyboard, and a keyboard identification number. This information is stored in a memory (not shown) which is a component of the note detect and assignor 14. The operation of a suitable note detect and assignor subsystem is described in U.S. Pat. No. 4,022,098 entitled "Keyboard Switch Detect And Assignor" which is hereby incorporated by reference.

A master data set comprising a set of points corresponding to equally spaced amplitude values for a musical waveshape is generated by the waveshape generator 201. While any of the known types of digital waveshape generators can be used to generate the master data set, it is advantageous to use the system disclosed in the previously referenced U.S. Pat. No. 4,085,644.

The general rule is that the maximum number of harmonics in the generated musical sounds is no greater than one-half of the number of equally spaced points defining one period of the musical waveshape. An advantageous choice is that of 64 data points which corresponds to a 32 harmonic capability for the musical tones. This is adequate for most electronic musical instruments.

A master data set is computed by the waveshape generator 201, as described in U.S. Pat. No. 4,085,644, with the omission of the first harmonic. This is done by setting to a zero value the magnitude of the first harmonic coefficient, used to calculate the master data set. The master data set is computed repetitively during a sequence of computation cycles. The computed master data is stored in a main register contained within the waveshape generator 201.

At the conclusion of a computation cycle, the master data set is transferred to a number of note registers which are components of a corresponding number of tone generators.

One such tone generator is shown explicitly in FIG. 1. A tone generator comprises the system blocks: note register 37, digital-to-analog converter 47, note clock 36, counter 101, sinusoid table 124, fundamental note register 137, multiplier 102, and digital-to-analog converter 115. The other tone generators, which are not shown, comprise similar system blocks. The output signals from the tone generators are added together in sum 55 and converted to audible sounds by means of the sound system 11.

As described in the referenced U.S. Pat. No. 4,085,644, the note select is used during the transfer cycle to direct the transfer of the master data set computed by the waveshape generator 201 in turn to each of the note registers contained in the tone tone generators such as the note register 37 shown in FIG. 1.

The fundamental note register 137 contains data corresponding to the missing first harmonic of the master data set. Thus the data stored in the fundamental note register are simply those corresponding to a sinusoid table for a complete sinusoid table of values corresponding to the number of data points comprising the master data set. This set of data points is called the fundamental data words.

The stored data is addressed simultaneously out of the note register 37 and the fundamental note register by means of timing signals generated by the note clock 36. The frequency of the note clock is controlled by the note detect and assignor 14 to correspond to the musical frequency of an actuated keyboard switch. This frequency is the fundamental musical frequency multiplied by the number of master data point values stored in the note register 37. Apparatus for implementing a note clock is described in U.S. Pat. No. 4,067,254 entitled "Frequency Number Controlled Clocks." This patent is hereby incorporated by reference.

The timing pulses created by the note clock 36 are divided in frequency by means of the counter 101. The result is a divided sequence of timing signals. Counter 101 is implemented to count modulo 512. Each time counter 101 returns to its minimal count state because of its modulo implementation a RESET signal is generated.

Counter 138 is implemented to count modulo 64 and is incremented by the RESET signal generated by counter 101.

The sinusoid table 124 contains values of the trigonometric sinusoid functions cos $(2\pi n/N)$ where N is the number of data points of the master data set stored in the note register 37 and the index n is an integer in the range $n=1,2,\ldots,N$. n is the memory address number for each sinusoid value selected in the sinusoid table 124. For the system implementation shown in FIG. 1, the fundamental note register 137 contains the values of sin $(2\pi n/N)$.

Trigonometric sinusoid values are addressed out of the sinusoid table 124 in response to the state of the counter 138. The data values addressed out of the sinusoid table 124 are used to multiply, or scale, the data values addressed out of the fundamental note register 137 by means of the mutiplier 102.

It is recognized that the combination of the note clock 36, counters 101 and 138, sinusoid table 24, fundamental note register 137, and the multiplier 137 comprises an implementation of the right hand side of Eq. 3. The net result is that the analog signal provided by the digital-to-analog converter 115 comprises the sum of the fundamental of the generated musical tone and a fundamental that is out-of-tune by 7 cents. The two out-of-tune frequencies are added to the output of the digital-to-analog converter 37 by means of sum 55 to generate a composite signal that has the desired ensemble effect.

An alternative method of obtaining the data stored in the fundamental note register is to divide each computation cycle into two segments. During the first segment of a computation cycle only the first harmonic coefficient of the set of harmonic coefficients corresponding to a preselected musical tone color is used. The computed data points for the master data set obtained during the first computation segment are stored in the fundamental note registers for all of the tone generators. All the remaining members of the selected set of harmonic coefficients are used during the second computation segment to generate a master data set which is stored in a main register contained in the waveshape generator 201.

Figure 2:
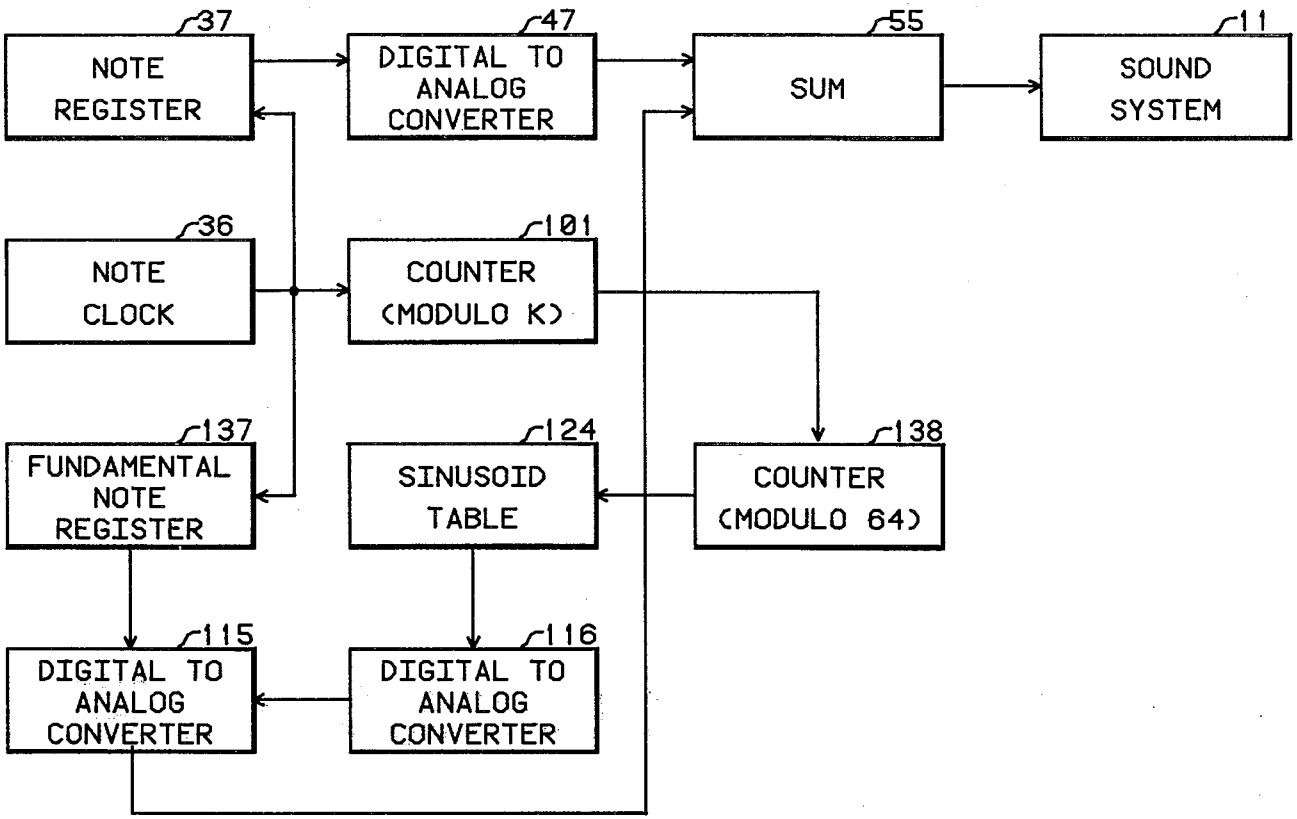
FIG. 2 is an alternative implementation of the ensemble tone generating system.

An alternative system configuration is shown in FIG. 2 for the basic system shown in FIG. 1 and previously described. In FIG. 2, the digital multiplier 102 of the system shown in FIG. 1 is replaced by a multiplying digital-to-analog converter 115. The digital trigonometric data values addressed out of the sinusoid table 124 are converted to analog signals which are used as the reference level for the digital-to-analog converter. In this fashion the digital-to-analog converter 115 provides an output analog signal which is the product of the data values read out of the fundamental note register 137 and the sinusoid table 124.

Figure 3:
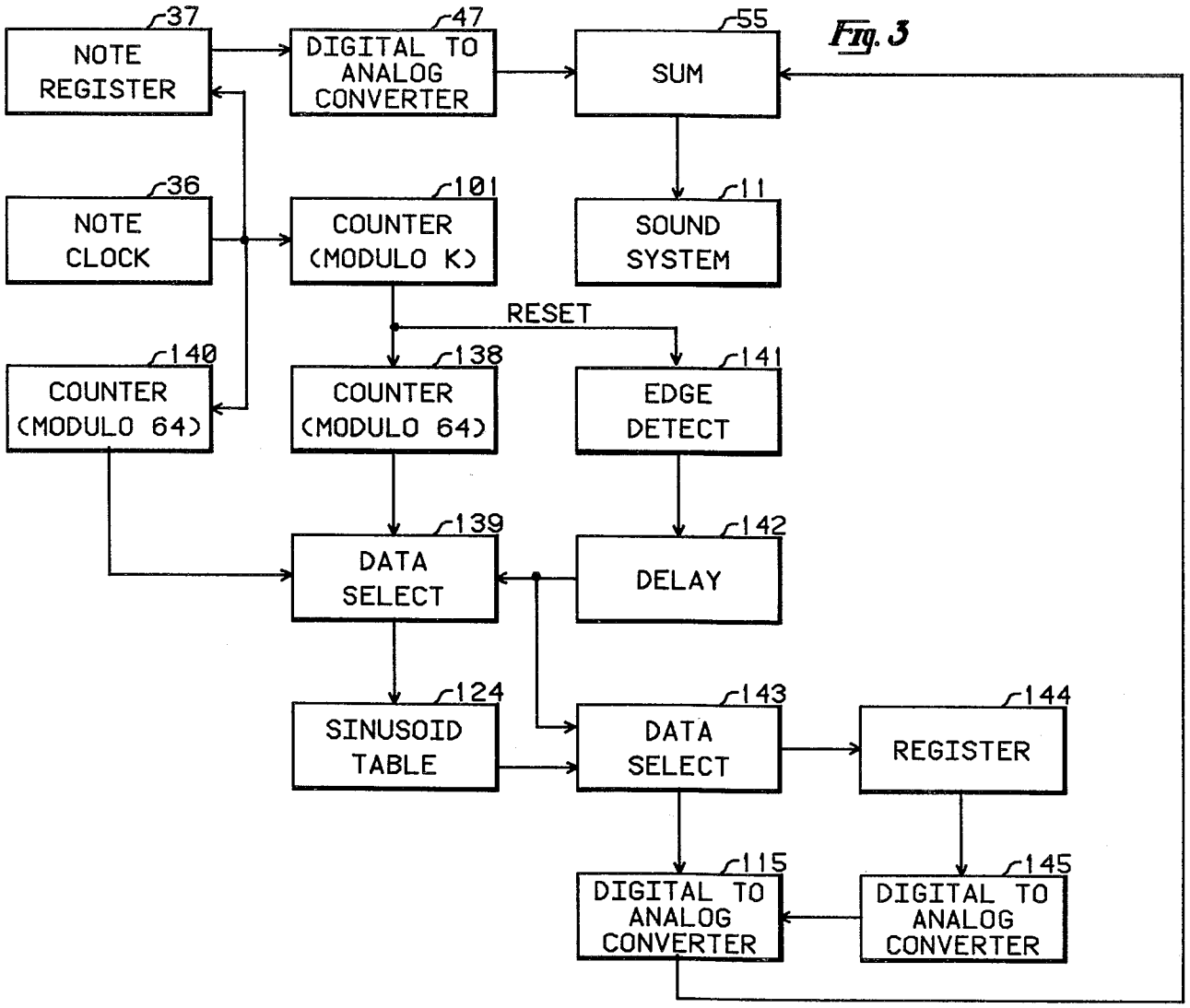
FIG. 3 is an alternative implementation which eliminates the fundamental note register.

Since essentially the same data is stored in both the fundamental note register 137 and the sinusoid table 124, one of these devices can be eliminated by the expedient of time sharing a single device. Such a time sharing arrangement is shown in FIG. 3.

Data select 139 is used to address sinusoid values out from the sinusoid table 124 in response either to the sate of counter 140 or to the state of counter 138. Counter 140 is implemented to count modulo 64 and is incremented by means of the timing signals provided by the note clock 36.

Data select 139 will select data from counter 140 unless it receives a signal from the delay 142. In response to a signal from the delay 142, data select 139 will select data from counter 138.

The RESET signal from counter 101 that is used to increment the counter 138 is converted into a pulse by means of the edge detect 141. This pulse is delayed by means of the delay 142 so that the signal transferred to the data select 139 does not coincide with a change of state of the counter 140.

When data select 139 causes a sinusoid value to be addressed out of the sinusoid table 124 in response to the content of counter 138, data select 143 in response to a signal from delay 142 causes the sinusoid value to be transferred and stored in the register 144.

The sinusoid values addressed out of the sinusoid table 124 in response to the states of counter 140 are transferred by data select 143 to the digital-to-analog converter 115.

The contents of register 144 are converted to analog signals by means of the digital-to-analog converter 145. This converted analog signal is used as a reference signal for the digital-to-analog converter 115 as previously described in reference to the system shown in FIG. 2.

The output analog signal from the multiplying digital-to-analog converter is combined with the signal output from the digital-to-analog converter 47 in sum 55 to produce the desired musical tone having an ensemble effect.

It is evident from Table 1, that ensemble effects with different amounts of detuning can be obtained by implementing counter 101 to count by other than a modulo 512 configuration. A detuning control can readily be implemented by using a counter having a modulo count action that is adjustable in response to a control signal. Such variable counters are well-known devices.

I claim:

1. In combination with a musical instrument having a waveshape memory storing a plurality of waveshape data words corresponding to the amplitudes of evenly spaced points defining a period of a musical signal and in which said waveshape data words are sequentially and repetitively read out of the waveshape memory and transferred to a wavehsape digital-to-analog converter to be converted into musical signals at a rate corresponding to the pitch of the generated musical tone, apparatus for producing an ensemble effect comprising;

computing means for computing said plurality of waveshape data words stored in said waveshape memory, a sinusoid table storing a plurality of trigonometric sinusoid values, a clock providing timing signals at a rate corresponding to the pitch of said generated musical tone, a first addressing means responsive to said timing signals for reading out waveshape data words stored in said waveshape memory, a first converting means comprising said waveshape digital-to-analog converter for converting waveshape data words read out of said waveshape memory into a first analog signal, a second addressing means responsive to said timing signals for reading out trigonometric sinusoid values from said sinusoid table, signal combination means responsive to trigonometric sinusoid values read out from said sinusoid table wherein a second analog signal is generated, and a summing means for adding said first analog signal and said second analog signal to produce a musical tone having said ensemble effect.

2. A musical instrument according to claim 1 wherein said computing means comprises a waveshape generating means whereby said plurality of waveshape data words are generated having a spectral content corresponding to a sequence of harmonic numbers $q=2,3,4,\ldots,N/2$, where N is the total number of said plurality of waveshape data words.

3. A musical instrument according to claim 1 wherein said sinusoid table comprises a first memory storing values of the trigonometric sinusoid function $\cos(2\pi n/N)$ where N is the total number of said plurality of waveshape data points and $n=1,2,3,\ldots,N$ is an integer denoting a memory address number.

4. A musical instrument according to claim 1 wherein said second addressing means comprises;

a first counter means incremented by said timing signals wherein the first counter means counts modulo a specified number K, a second counter means incremented each time said first counter means returns to its initial state wherein said second counter means counts modulo the number of data words comprising said plurality of waveshape data words, a second memory for storing data values, first addressing circuitry responsive to the state of said second counter means for addressing trigonometric sinusoid values from said sinusoid table and for storing said sinusoid values in said second memory, a third counter means incremented by said timing signals wherein the third counter means counts modulo the number of data words comprising said plurality of waveshape data words, and second addressing circuitry responsive to the state of said third counter means for addressing out trigonometric sinusoid values from said sinusoid table.

5. A musical instrument according to claim 4 wherein said signal combination means comprises;

multiplication means whereby trigonometric sinusoid values addressed out by said second addressing circuitry are multiplied by data values stored in said second memory to provide product data values, and a second converting means for converting said product data values to a second analog signal.

6. A musical instrument according to claim 4 wherein said second addressing means further comprises a modulo number generator for creating selected values of said specified number K.

7. In combination with a musical instrument having a waveshape memory storing a plurality of waveshape data words corresponding to the amplitudes of evenly spaced points defining a period of a musical signal and in which said waveshape data words are sequentially and repetitively read out of the waveshape memory and transferred to a waveshape digital-to-analog converter to be converted into musical signals at a rate corresponding to the pitch of the generated musical tone, apparatus for producing an ensemble effect comprising;

computing means for computing said plurality of waveshape data words stored in said waveshape memory, a first memory storing a plurality of fundamental data words, a sinusoid table storing a plurality of trigonometric sinusoid values, a clock providing timing signals at a rate corresponding to the pitch of said generated musical tone, a first addressing means responsive to said timing signals for reading out waveshape data words stored in said waveshape memory, a first converting means comprising said digital-to-analog converter for converting waveshape data words read out of said waveshape memory into a first analog signal, a frequency divider means responsive to said timing signals for providing a divided sequence of timing signals, a second addressing means responsive to said divided sequence of timing signals for reading out trigonometric sinusoid values from said sinusoid table, a third addressing means responsive to said timing signals for reading out fundamental data words from said first memory, a multiplying means whereby said fundamental data words read out from said first memory are multiplied by said trigonometric sinusoid values read out from said sinusoid table to generate product data values, a second converting means for converting said product data values into a second analog signal, and a summing means for adding said first analog signal and said second analog signal to produce a musical tone having said ensemble effect.

8. A musical instrument according to claim 7 wherein said computing means comprises a waveshape generating means whereby said plurality of waveshape data words are generated having a spectral content corresponding to a sequence of harmonic numbers $q=2,3,4,\ldots,N/2$ where N is the total number of said plurality of waveshape data words.

9. A musical instrument according to claim 7 wherein said computing means comprises;

a fundamental waveshape generating means whereby said plurality of fundamental data words are generated having a spectral content corresponding to the first harmonic of said audio musical signal, and transfer means for storing said plurality of fundamental data words in said first memory.

10. A musical instrument according to claim 7 wherein said sinusoid table comprises a second memory storing values of the trigonometric sinusoid function $\cos(2\pi n/N)$ where N is the total number of said plurality of waveshape data points and $n=1,2,3,\ldots N$ is an integer denoting a memory address number.

11. A musical instrument according to claim 7 wherein said frequency divider means comprises;

a first counter means incremented by said timing signals wherein the first counter means counts modulo a specified number K, and a second counter means incremented each time said first counter means returns to its initial state wherein said second counter means counts modulo the number of data words comprising said plurality of waveshape data words.

12. A musical instrument according to claim 11 wherein said frequency divider means further comprises a modulo number generator for creating selected values of said specified number K.

13. A musical instrument according to claim 11 wherein said second addressing means comprises;

addressing circuitry responsive to the state of said second counter means whereby memory address numbers are generated for reading out trigonometric sinusoid values from said sinusoid table.

* * * * *